US007786395B2

(12) United States Patent
Ozias et al.

(10) Patent No.: US 7,786,395 B2
(45) Date of Patent: Aug. 31, 2010

(54) ILLUMINATED INDICATOR ON AN INPUT DEVICE

(75) Inventors: Orin M. Ozias, Cedar Park, TX (US); Kevin Mundt, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 151 days.

(21) Appl. No.: 11/941,239

(22) Filed: Nov. 16, 2007

(65) Prior Publication Data

US 2009/0127084 A1 May 21, 2009

(51) Int. Cl.
*H01H 9/00* (2006.01)

(52) U.S. Cl. ..... 200/314

(58) Field of Classification Search ..... 200/310–314, 200/315, 521, 513, 341
See application file for complete search history.

(56) References Cited

U.S. PATENT DOCUMENTS

| | | | | |
|---|---|---|---|---|
| 4,334,134 | A * | 6/1982 | Janda | 200/314 |
| 4,449,024 | A | 5/1984 | Stracemer | |
| 5,252,798 | A * | 10/1993 | Kamada | 200/314 |
| 5,285,037 | A * | 2/1994 | Baranski et al. | 200/314 |
| 6,860,612 | B2 | 3/2005 | Chuang et al. | |
| 6,918,677 | B2 | 7/2005 | Shipman | |
| 7,244,898 | B2 * | 7/2007 | Kim | 200/314 |
| 7,394,033 | B2 * | 7/2008 | Kim | 200/296 |

* cited by examiner

*Primary Examiner*—Edwin A. Leon
(74) *Attorney, Agent, or Firm*—Haynes and Boone, LLP

(57) ABSTRACT

An input device includes a base. A keycap is coupled to the base by a key guide structure, wherein the keycap defines an aperture. A flexible illumination guide is coupled to the base and is located immediately adjacent the aperture. An illumination device is coupled to the base and is operable to provide illumination through the flexible illumination guide and out of the aperture.

20 Claims, 5 Drawing Sheets

ILLUMINATED INDICATOR ON AN INPUT DEVICE

BACKGROUND

The present disclosure relates generally to information handling systems, and more particularly to an illuminated indicator on an input device used with an information handling system.

As the value and use of information continues to increase, individuals and businesses seek additional ways to process and store information. One option is an information handling system (IHS). An IHS generally processes, compiles, stores, and/or communicates information or data for business, personal, or other purposes. Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, or global communications. In addition, IHSs may include a variety of hardware and software components that may be configured to process, store, and communicate information and may include one or more computer systems, data storage systems, and networking systems.

Some IHSs include input devices such as, for example, keyboards, that are used to provide input to the IHS. In some situations, it may be desirable to illuminate keys on the keyboard to indicate a variety of different information to a user. For example, when a user activates the "Caps Lock" function on a keyboard in order to input all keystrokes in capital letters, it may be desirable to illuminate the "Caps Lock" activation key to indicate to the user that the "Caps Lock" function has been activated. Illuminating the keys can raise a number of issues.

Conventionally, desktop keyboards have included illuminated keys to indicate information. An illumination device (e.g., an LED) is typically provided adjacent the key and allowed to provide illumination through an aperture in the key. It is desirable to prevent the light from the illumination device from "bleeding" out or escaping from around the edges of the key. The construction of a desktop keyboard provides the keys a stroke of sufficient length as to allow a concentric light shield such as, for example, a plastic tube that extends from the aperture on the key and mates with a plastic tube extending from the illumination device, in order to channel the illumination from the illumination device, through the mated tubes, and out of the aperture.

However, with portable IHSs and some thin keyboards, the thickness of the keyboard assembly is reduced to a minimum to facilitate reduced thickness of the device. Such reduced thickness does not provide the keys with a stroke of sufficient length to allow for a concentric light shield as is conventionally practiced. As such, illumination from an illumination device provided adjacent the keys tends bleed out or escape from around the edges of the key. The typical solution to this is to move the indicator to another area of the keyboard, such as, for example, on a panel above the top row of function keys on the keyboard. This requires the user to find the location on the keyboard for the indicator, rather than be able to simply look to the key that activated the function and determine whether or not the function is activated.

Accordingly, it would be desirable to provide an improved illuminated indicator on an input device.

SUMMARY

According to one embodiment, an input device includes a base, a keycap coupled to the base by a key guide structure, wherein the keycap defines an aperture, a flexible illumination guide being coupled to the base and being located immediately adjacent the aperture; and an illumination device coupled to the base and operable to provide illumination through the flexible illumination guide and out of the aperture.

DETAILED DESCRIPTION

For purposes of this disclosure, an IHS may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an IHS may be a personal computer, a PDA, a consumer electronic device, a network server or storage device, a switch router or other network communication device, or any other suitable device and may vary in size, shape, performance, functionality, and price. The IHS may include memory, one or more processing resources such as a central processing unit (CPU) or hardware or software control logic. Additional components of the IHS may include one or more storage devices, one or more communications ports for communicating with external devices as well as various input and output (I/O) devices, such as a keyboard, a mouse, and a video display. The IHS may also include one or more buses operable to transmit communications between the various hardware components.

Figure 1:
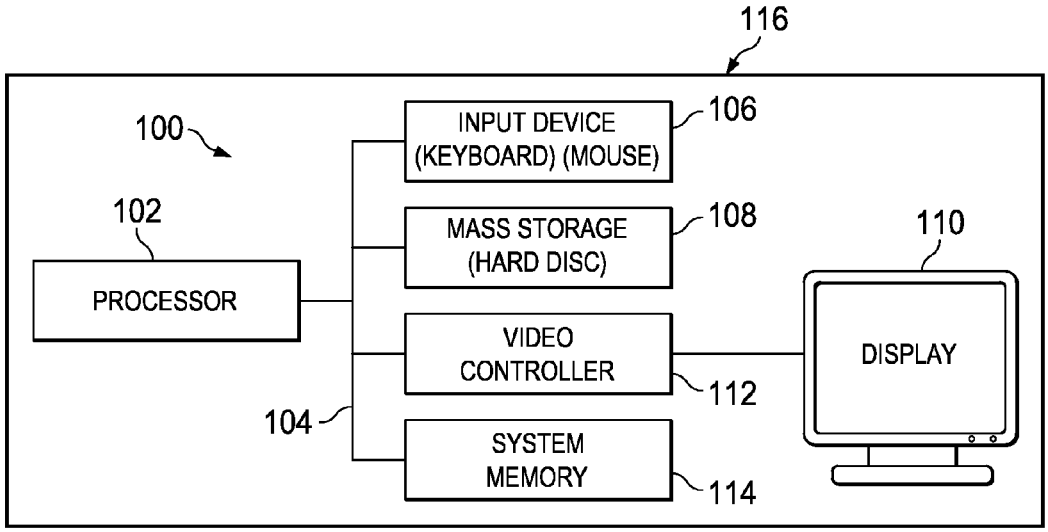
FIG. 1 is a schematic view illustrating an embodiment of an IHS.

In one embodiment, IHS 100, FIG. 1, includes a processor 102, which is connected to a bus 104. Bus 104 serves as a connection between processor 102 and other components of computer system 100. An input device 106 is coupled to processor 102 to provide input to processor 102. Examples of input devices include keyboards, touchscreens, and pointing devices such as mouses, trackballs and trackpads. Programs and data are stored on a mass storage device 108, which is coupled to processor 102. Mass storage devices include such devices as hard disks, optical disks, magneto-optical drives, floppy drives and the like. IHS 100 further includes a display 110, which is coupled to processor 102 by a video controller 112. A system memory 114 is coupled to processor 102 to provide the processor with fast storage to facilitate execution of computer programs by processor 102. In an embodiment, a chassis 116 houses some or all of the components of IHS 100. It should be understood that other buses and intermediate circuits can be deployed between the components described above and processor 102 to facilitate interconnection between the components and the processor 102.

Figure 2:
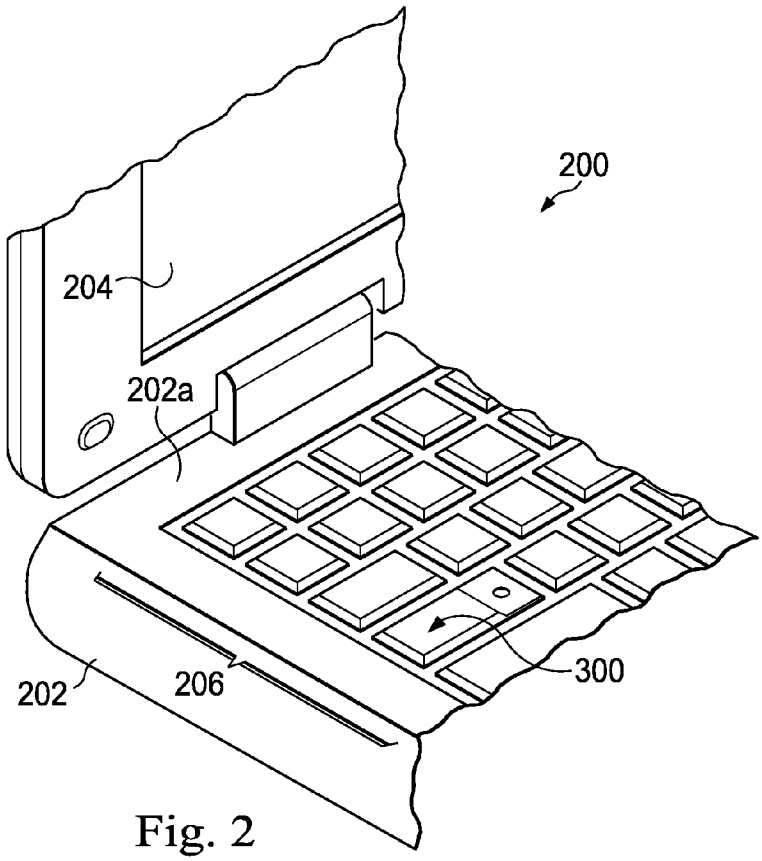
FIG. 2 is a perspective view illustrating an embodiment of an input device.

Referring now to FIG. 2, an IHS 200 is illustrated. In an embodiment, the IHS 200 may be, for example, the IHS 100, described above with reference to FIG. 1. In an embodiment, the IHS 200 is a portable IHS such as, for example, a laptop or notebook computer. The IHS 200 includes a chassis 202 having a top surface 202*a*. A display 204 is moveably coupled to the chassis 202. An input device 206 is located adjacent the top surface 202*a* of the chassis 202. In an embodiment, the input device 206 may be, for example, the input device 106 of the IHS 100, described above with reference to FIG. 1. While the input device 206 is illustrated as integral with the IHS 200, one of skill in the art will recognize that the input device 206 may also be a component that may be coupled to an IHS by, for example, a cable or through a wireless connection, such as in the case of a keyboard that may be connected to a computer.

Figure 3A:
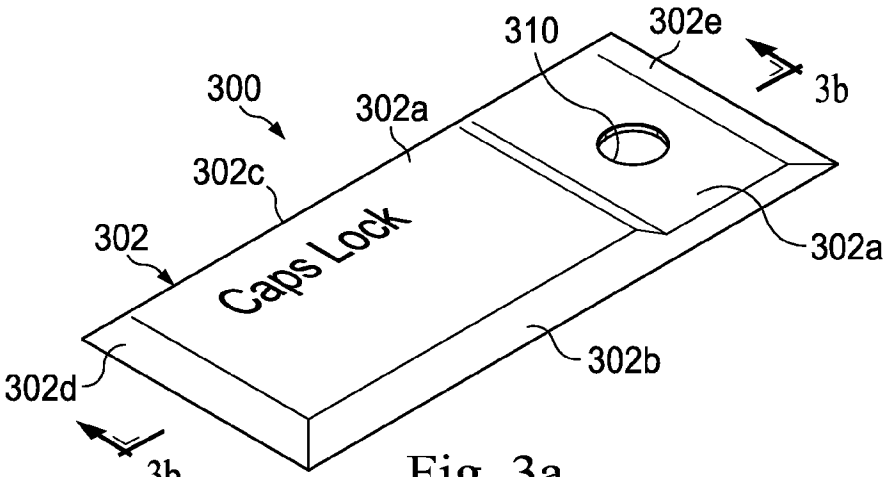
FIG. 3*a* is a perspective view illustrating an embodiment of a keycap used with the input device of FIG. 2.
Figure 3B:
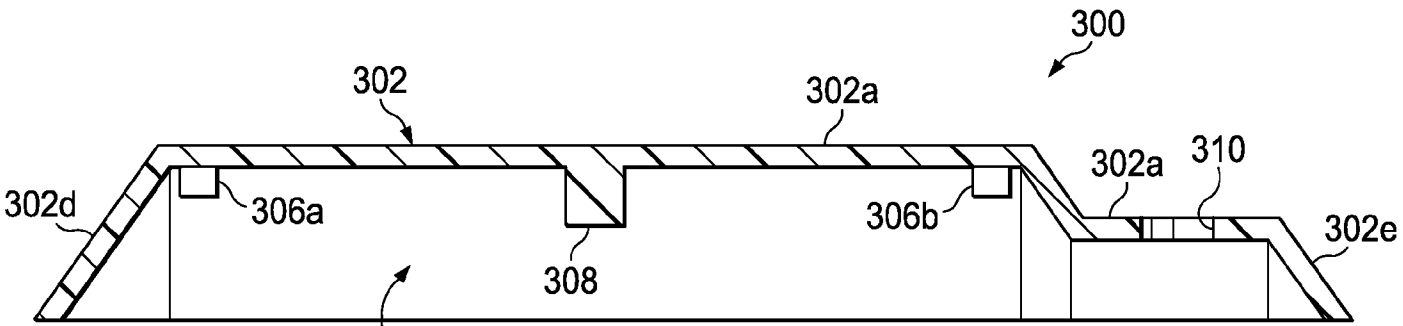
FIG. 3*b* is a cross sectional view illustrating an embodiment of the keycap key of FIG. 3*a*.

Referring now to FIGS. 2, 3*a* and 3*b*, the input device 206 includes key 300. The key 300 includes a keycap 302 having a top wall 302*a*, a front wall 302*b* extending from the top wall 302*a*, a rear wall 302*c* extending from the top wall 302*a* and located opposite the front wall 302*b*, and a pair of opposing side walls 302*d* and 302*e* extending between the top wall 302*a*, the front wall 302*b*, and the rear wall 302*c*. A housing 304 is defined by the keycap 302 between the top wall 302*a*, the front wall 302*b*, the rear wall 302*c*, and the side walls 302*d* and 302*e*. A pair of key guide coupling members 306*a* and 306*b* extend from the top wall 302*a* and into the housing 304 in a spaced apart orientation from each other. Additional key guide coupling members (not shown) may be included on the keycap 302. A key switch engagement member 308 extends from the top wall 302*a* and into the housing 304 and is located between the pair of key guide coupling members 306*a* and 306*b*. An aperture 310 is defined by the top surface 302*a* of the key 300 and extends through the top surface 302*a* to the housing 304. In an embodiment, the aperture 310 may include a transparent material such as, for example, a clear plastic material, a lens, and/or a variety of other materials known in the art that allow light to pass through them. In an embodiment, there is no material located in the aperture.

Figure 4A:
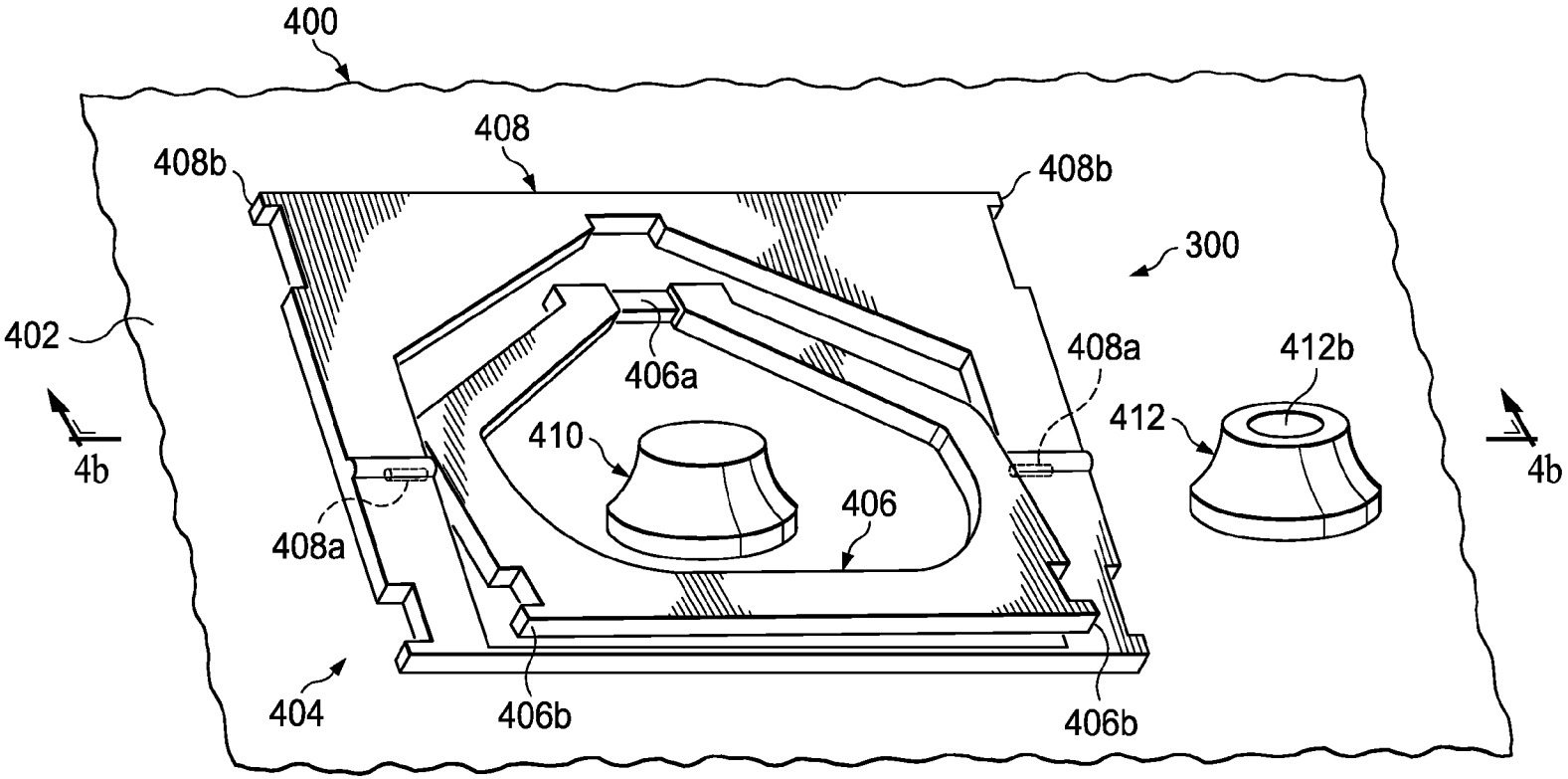
FIG. 4*a* is a perspective view illustrating an embodiment of a key guide structure used with the input device of FIG. 2 and the keycap of FIGS. 3*a* and 3*b*.
Figure 4B:
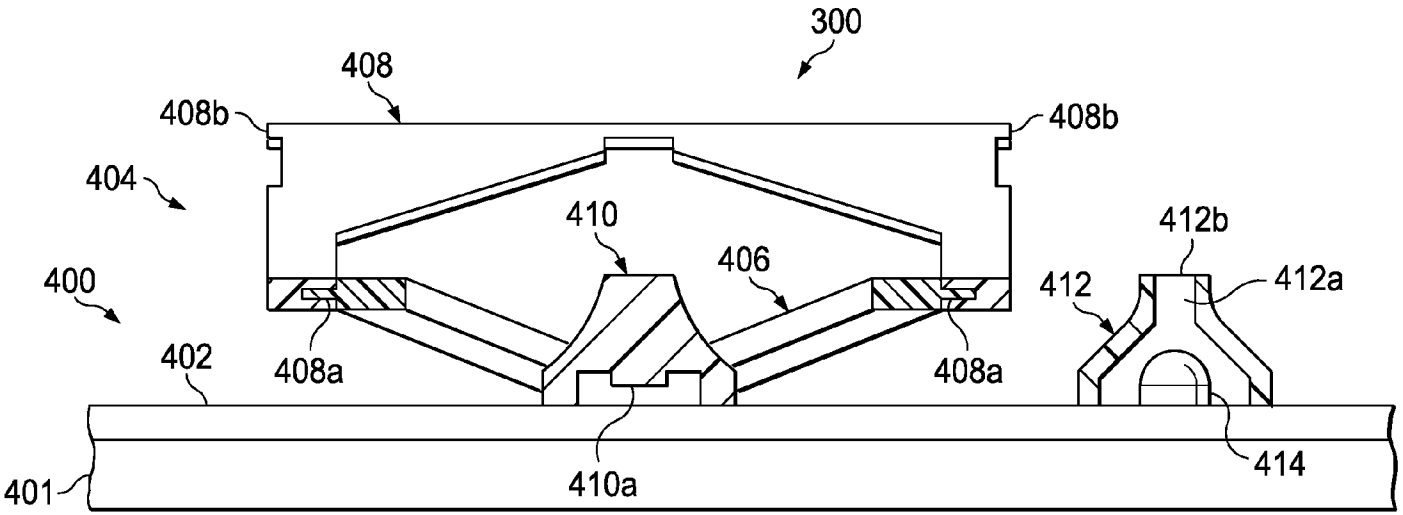
FIG. 4*b* is a cross sectional view illustrating an embodiment of the key guide structure of FIG. 4*a*.
Figure 5A:
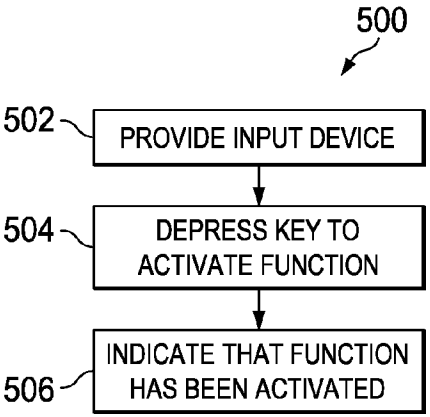
FIG. 5*a* is a flow chart illustrating an embodiment of a method to illuminate a key on an input device.
Figure 5B:
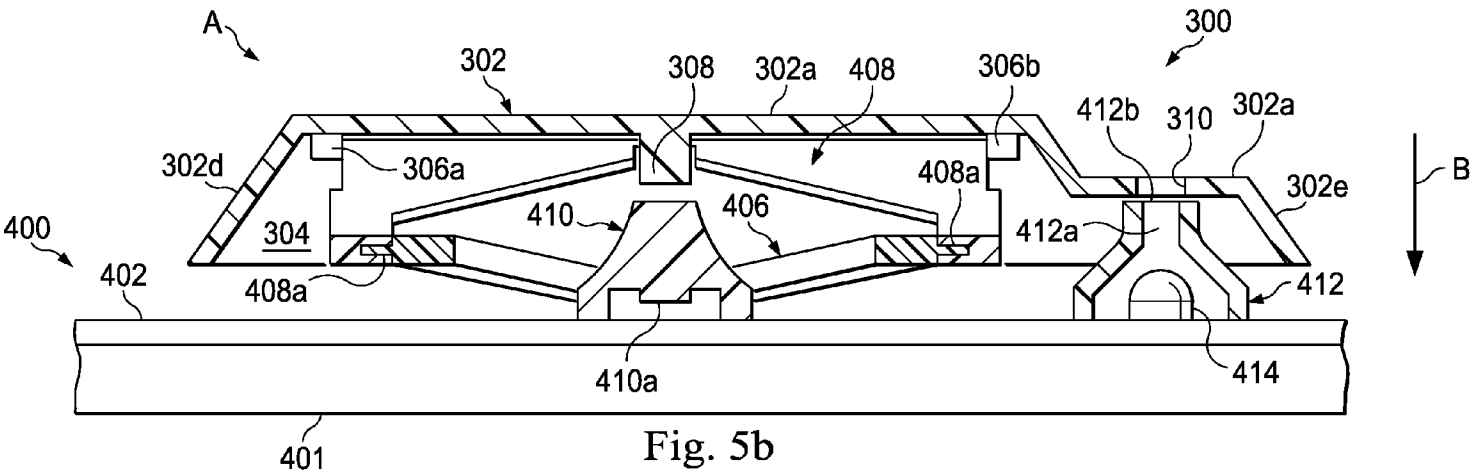
FIG. 5*b* is a cross sectional view illustrating an embodiment of the keycap of FIG. 3*a* and 3*b* coupled to the key guide structure of FIGS. 4*a* and 4*b*.
Figure 5C:
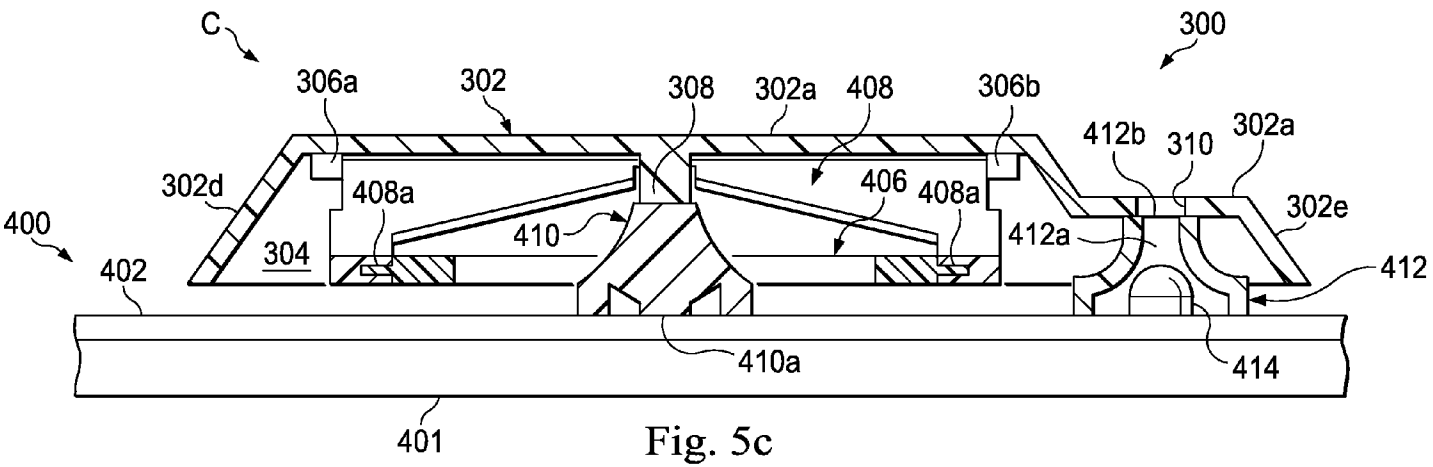
FIG. 5*c* is a cross sectional view illustrating an embodiment of the keycap of FIG. 3*a* and 3*b* coupled to the key guide structure of FIGS. 4*a* and 4*b* and depressed.

Referring now to FIGS. 1, 2, 4*a* and 4*b*, the key 300 also includes a base 400 on the chassis 202 of the IHS 200 that may be part of, or located adjacent to, the top surface 202*a* of the chassis 202. The base 400 includes a baseplate 401 and switch membrane 402 located adjacent the baseplate 401. In an embodiment, the switch membrane 402 may be coupled to the processor 102 of the IHS 100, described above with reference to FIG. 1. A key guide structure 404 is coupled to the base 400, with a first guide section 406 connected to the base 400 through a pivotal coupling 406*a*. The first guide section 406 includes a plurality of key coupling members 406*b* that are located on the first guide section 406 opposite the pivotal coupling 406*a*. A second guide section 408 is pivotally coupled to the first guide section 406 by a pair of pivotal couplings 408*a*. The second guide section 408 includes a plurality of key coupling members 408*b* located opposite the key guide structure 404 from the key coupling members 406*b*. A flexible key switch 410 is coupled to and located on the base 400 such that the key guide structure 404 surrounds the flexible key switch 410. The flexible key switch 410 includes a switch membrane engagement member 410*a* that is spaced apart from the switch membrane 402 when the flexible key switch 410 is not flexed, as illustrated in FIG. 4*b*. In an embodiment, the flexible key switch 410 is fabricated out of a resilient material such as, for example, a rubber material. A flexible illumination guide 412 is coupled to the base 400 and located adjacent the key guide structure 404 and the flexible key switch 410. The flexible illumination guide 412 defines both a housing 412*a* located within the flexible illumination guide 412 and a housing entrance 412*b* that extends through the flexible illumination guide 412 to the housing 412*a*. In an embodiment, the flexible illumination guide 412 is fabricated out of a resilient material such as, for example, a rubber material. In an embodiment, the flexible illumination guide 412 is fabricated out of the same material as the flexible key guide 410. An illumination device 414 is coupled to the base 400 and located in the housing 412*a* defined by the flexible illumination guide 412 when the flexible illumination guide 412 is coupled to the base 400. In an embodiment, the illumination device may be, for example, a Light Emitting Device (LED) or a variety of other illumination producing devices known in the art. In an embodiment, the illumination device 414 is coupled to the base 400 using Surface Mount Technology (SMT) such that the illumination device 414 may receive the power necessary to provide illumination. In an embodiment, the illumination device 414 is coupled to the processor 102 in the IHS 100, described above with reference to FIG. 1.

Referring now to FIGS. 1, 2, 3*a*, 3*b*, 4*a*, 4*b*, 5*a*, 5*b* and 5*c*, a method 500 for providing an illuminated indicator on an input device is illustrated. The method 500 begins at block 502 where an input device is provided. The input device 206, described above with reference to FIGS. 2, 3*a*, 3*b*, 4*a* and 4*b*, may be provided. The keycap 302, described above with reference to FIGS. 3*a* and 3*b*, is coupled to the key guide structure 404, described above with reference to FIGS. 4*a* and 4*b*, by engaging the key coupling members 408*b* on the second guide section 408 with the key guide coupling members 306*a* and 306*b* on the keycap 302. The key coupling members 406*b* on the first guide section 406 may also be engaged with the key guide coupling members on the keycap 302 (not visible in the cross sectional view of FIG. 3*b*.) With the keycap 302 coupled to the key guide structure 404, the key switch engagement member 308 on the keycap 302 is substantially aligned with the flexible key switch 410 and the aperture 310 defined by the keycap 302 is substantially aligned with the housing entrance 412*b* on the flexible illumination guide 412. With the keycap 302 coupled to the key guide structure 404, the keycap 302 is held in a first position A, illustrated in FIG. 5*b*. The method 500 then proceeds to block 504 where the key 300 on the input device 206 is depressed to activate a function. The key 300 may be depressed by a user by engaging the top surface 302*a* of the keycap 302 to move the keycap 302 in a direction B. Movement of the keycap 302 in the direction B moves the keycap 302 into a second position C, illustrated in FIG. 5*c*, and causes the flexible key switch 410 to flex due to the engagement of the key switch engagement member 308 and the flexible key switch 410. Flexing of the flexible key switch 410 causes the switch membrane engagement member 410*a* to engage the switch membrane 402, resulting in a signal that is sent to the processor 102 to activate a function such as, for example, a "Caps Lock" function that results in all alphabet keystrokes to be presented in capital letters, a "Numbers Lock" function that results in all numerical keystrokes to be presented as numbers, and/or a variety of other functions known in the art. Movement of the keycap 302 in the direction B and into the second position C also results in the engagement of the keycap 302 and the flexible illumination guide 412 and causes the flexible illumination guide 412 to flex, illustrated in FIG. 5*c*. In an embodiment, the engagement of the keycap 302 with the flexible key switch 410 and the flexible illumination guide 412 occurs substantially simultaneously. Once the function has been activated by the engagement of the switch membrane engagement member 410*a* and the switch membrane 402, a signal is sent by the processor 102 to the illumination device 414 that causes the illumination device 414 to illuminate in order to provide an indication that the function has been activated. The illumination from the illumination device 414 may only escape the flexible illumination guide 412 through the housing 412*a* and out of the housing entrance 412*a*. Due to the alignment of the housing entrance 412*a* and the aperture 310 defined by the keycap 302, that illumination is directed through the aperture 310 to provide an indication that the function has been activated. Release of the keycap 302 will cause the keycap 302 to move in a direction opposite the direction B and back into the first position A. With the function still activated, the illumination device 414 will continue to provide illumination through the aperture 310. In an embodiment, the flexible illumination guide 412 substantially prevents the illumination from escaping from the area between the keycap 302 and the base 400 and ensures that substantially all of the illumination from the illumination device 414 is directed through the aperture 310. In an embodiment, the keycap 302 may be depressed again in the direction A to deactivate the function, and the flexing of the flexible illumination guide 412 does not cause the obstruction of the illumination out through the aperture 310. Thus, a system and method are provided that allow for the illumination of a key on an input device with space constraints while directing the illumination to prevent the escape of the illumination from undesirable areas around the key.

In an embodiment, during the manufacture of the input device 206, automation may be used to couple the flexible key switch 410 to the switch membrane 402. A vibratory mechanism may be used to align the plurality of flexible key switches 410 in an assembly fixture for placement on the switch membrane 402. In an embodiment, the flexible illumination guide 412 may be fabricated with a different profile than the flexible key switch 410 such that the flexible illumination guide 412 and the flexible key switch 410 do not fit in the same automatic fixture.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. An input device, comprising:

a base;

a keycap coupled to the base by a key guide structure that holds the keycap in a position that provides a space between the keycap and the base, wherein the keycap defines an aperture;

an illumination device coupled to the base adjacent the aperture;

a flexible illumination guide extending from the base and about the perimeter of the illumination device, wherein the flexible illumination guide is operable to flex in response to engaging the keycap; and wherein the illumination device is operable to provide illumination through the flexible illumination guide and out of the aperture, and wherein the flexible illumination guide prevents illumination from escaping directly from the perimeter of the illumination device and through the space between the keycap and the base.

2. The device of claim 1, further comprising:

a flexible key switch coupled to the base adjacent the key guide structure.

3. The device of claim 2, wherein the base comprises a switch membrane, and wherein the keycap is operable to engage the flexible key switch to cause the flexible key switch to engage the switch membrane to activate a function.

4. The device of claim 2, wherein the keycap is operable to engage the flexible illumination guide and the flexible key switch substantially simultaneously.

5. The device of claim 1, wherein the illumination device comprises a light emitting device (LED) that is mounted to the base.

6. The device of claim 4, wherein an illumination channel is defined by the flexible illumination guide, and wherein the LED is located in the illumination channel.

7. The device of claim 1, further comprising:

a transparent material located in the aperture.

8. The device of claim 1, wherein illumination from the illumination device is not obstructed by the flexing of the flexible illumination guide.

9. An information handling system, comprising:

a chassis;

a processor mounted in the chassis; and an input device located on the chassis and coupled to the processor, the input device comprising:

a keycap coupled to the chassis by a key guide structure that holds the keycap in a position that provides a space between the keycap and the chassis, wherein the keycap comprises an aperture;

an illumination device coupled to the chassis adjacent the aperture;

a flexible illumination guide extending from the chassis and about the perimeter of the illumination device, wherein the flexible illumination guide is operable to flex in response to engaging the keycap; and wherein the illumination device is operable to provide illumination through the flexible illumination guide and out of the aperture, and wherein the flexible illumination guide prevents illumination from escaping directly from the perimeter of the illumination device and through the space between the keycap and the base.

10. The system of claim 9, further comprising:

a flexible key switch coupled to the chassis adjacent the key guide structure.

11. The system of claim 10, wherein the chassis comprises a switch membrane, and wherein the keycap is operable to engage the flexible key switch to cause the flexible key switch to engage the switch membrane to activate a function.

12. The system of claim 10, wherein the keycap is operable to engage the flexible illumination guide and the flexible key switch substantially simultaneously.

13. The system of claim 9, wherein the illumination device comprises a light emitting device (LED) that is mounted to the chassis.

14. The system of claim 13, wherein an illumination channel is defined through the flexible illumination guide, and wherein the LED is located in the illumination channel.

15. The system of claim 9, further comprising:

a transparent material located in the aperture.

16. The system of claim 9, wherein illumination from the illumination device is not obstructed by the flexing of the flexible illumination guide.

17. A method for providing an illuminated indicator on an input device, comprising:

providing a keycap coupled to a input device by a key guide structure that holds the keycap in a position that provides a space between the keycap and the input device;

depressing the keycap to activate a function, wherein the depressing of the keycap causes the keycap to engage and flex a flexible illumination guide, and wherein the activation of the function results in the illumination of an illumination device located adjacent the flexible illumination guide; and indicating that the function has been activated by channeling the illumination from the illumination device through the flexible illumination guide and out of an aperture defined by the keycap, wherein the flexible illumination guide is positioned about the perimeter of the illumination device in order to prevent illumination from escaping directly from the perimeter of the illumination device and through the space between the keycap and the input device.

18. The method of claim 17, wherein the depressing of the keycap causes the keycap to engage and flex a flexible key switch substantially simultaneously with the engagement and flexing of the flexible illumination guide, and wherein the engagement and flexing of the flexible key switch activates the function.

19. The method of claim 17, wherein the flexing of the flexible illumination guide does not obstruct the illumination from the illumination device.

20. The method of claim 17, wherein the flexible illumination guide defines an illumination channel and the illumination device is located in the illumination channel, and wherein the indicating that the function has been activated comprises directing the illumination from the illumination device through the illumination channel and out of the aperture.

* * * * *